US011000858B2

(12) United States Patent
Patrick et al.

(10) Patent No.: US 11,000,858 B2
(45) Date of Patent: May 11, 2021

(54) MULTI-AXIS CENTRIFUGE

(71) Applicant: Spherical Holdings, LLC, Los Angeles, CA (US)

(72) Inventors: David M. Patrick, Ladera Ranch, CA (US); Robert S. Patrick, Plano, TX (US)

( * ) Notice: Subject to any disclaimer, the term of this patent is extended or adjusted under 35 U.S.C. 154(b) by 469 days.

(21) Appl. No.: 15/949,089

(22) Filed: Apr. 10, 2018

(65) Prior Publication Data

US 2021/0060580 A1 Mar. 4, 2021

(51) Int. Cl.
*B04B 9/02* (2006.01)
*B04B 5/00* (2006.01)

(52) U.S. Cl.
CPC . *B04B 9/02* (2013.01); *B04B 5/00* (2013.01)

(58) Field of Classification Search
CPC ..... B04B 9/02; B04B 5/00
USPC ..... 494/47, 51
See application file for complete search history.

(56) References Cited

U.S. PATENT DOCUMENTS

| | | | |
|---|---|---|---|
| 2,967,329 A | 1/1961 | Friedland et al. | |
| 3,275,733 A | 9/1966 | Schule et al. | |
| 3,340,619 A | 9/1967 | Bertin | |
| 3,347,971 A | 10/1967 | Mankowich et al. | |
| 3,652,760 A | 3/1972 | Petri | |
| 3,788,392 A | 1/1974 | Suzuki | |
| 3,841,165 A | 10/1974 | Benzing et al. | |
| 3,929,182 A | 12/1975 | Amado, Jr. | |
| 4,050,875 A | 9/1977 | Katzman et al. | |
| 4,104,357 A | 8/1978 | Blair | |
| 7,241,114 B2 | 7/2007 | Koeppler | |
| 9,457,398 B2 | 10/2016 | Ciardullo | |
| 2011/0042864 A1* | 2/2011 | Naef | B29C 41/06 264/503 |
| 2012/0301667 A1* | 11/2012 | Ryabova | B05C 13/02 428/137 |
| 2016/0346964 A1 | 12/2016 | Nurnberg et al. | |

FOREIGN PATENT DOCUMENTS

| | | |
|---|---|---|
| GB | 1254090 | 11/1971 |
| GB | 2543815 A | 3/2017 |

OTHER PUBLICATIONS

WO, PCT/US2019/026793 ISR and Written Opinion, dated Jul. 5, 2019.

* cited by examiner

*Primary Examiner* — Walter D. Griffin
*Assistant Examiner* — Shuyi S. Liu
(74) *Attorney, Agent, or Firm* — Cionca IP Law P.C.; Marin Cionca

(57) ABSTRACT

A centrifuge has a mechanical drive coupled to a capsule rotatable simultaneously about mutually orthogonal X, Y, and Z axes. A stationary base has a first motor driving a centrally located hub in rotation about the Z axis. The hub has a pair of colinear arms and a pair of struts extending from the arms to support an outer ring. An inner ring is positioned concentric with the outer ring and a second motor is engaged with both the outer ring and inner ring so that it is enabled for rotating the inner ring relative to the outer ring. A third motor is engaged with both the inner ring and the capsule for rotating said capsule relative to the inner ring. The simultaneous rotation of the capsule about all three axes is therefore possible.

7 Claims, 2 Drawing Sheets

MULTI-AXIS CENTRIFUGE

FIELD OF THE DISCLOSURE

The field of this disclosure is related to centrifuge apparatus for separation of fluids by the use of such centrifuges.

BACKGROUND

Generally, a centrifuge is an apparatus that puts an object in rotation around a fixed axis, applying a potentially strong radial force perpendicular to the axis of spin. The centrifuge works using the sedimentation principle, where centripetal acceleration causes denser substances and particles that are held within the spinning container, to move outward in the radial direction. At the same time, objects that are less dense are displaced and forced toward the axis of spin. In a laboratory centrifuge that uses sample tubes, the radial acceleration causes denser particles to settle to the bottom of the tube, while low-density substances rise to the top. There are three types of centrifuge designed for different applications. Industrial scale centrifuges are commonly used in manufacturing and waste processing to sediment suspended solids, or to separate immiscible liquids. An example is the cream separator found in dairies. Very high-speed centrifuges and ultracentrifuges are able to provide very high accelerations separating fine particles down to the nanoscale, and also molecules of different masses. Gas centrifuges are used for isotope separation, such as to enrich nuclear fuel to obtain fissile isotopes.

A wide variety of laboratory-scale centrifuges are used in chemistry, biology, biochemistry and clinical medicine for isolating and separating suspensions and various fluid substances. They vary widely in speed, capacity, temperature control, and other characteristics. Laboratory centrifuges often can accept a range of different fixed-angle and swinging bucket rotors able to carry different numbers of centrifuge tubes and rated for specific maximum speeds. Controls vary from simple electrical timers to programmable models able to control acceleration and deceleration rates, running speeds, and temperature regimes. Ultracentrifuges spin the rotors under vacuum, eliminating air resistance and enabling exact temperature control. Zonal rotors and continuous flow systems are capable of handing bulk and larger sample volumes, respectively, in a laboratory-scale instrument. An important application in medicine is blood separation. Blood separates into cells and proteins (RBC, WBC, platelets, etc.) and serum. DNA preparation is another common application for pharmacogenetics and clinical diagnosis. DNA samples are purified and the DNA is prepped for separation by adding buffers and then centrifuging it for a certain amount of time. The blood waste is then removed and another buffer is added and spun inside the centrifuge again. Once the blood waste is removed and another buffer is added the pellet can be suspended and cooled. Proteins can then be removed and with further centrifuging DNA may be isolated completely. Protocols for centrifugation typically specify the amount of acceleration to be applied to the sample, rather than specifying a rotational speed, i.e., revolutions per minute. This distinction is important because two rotors with different diameters running at the same rotational speed will subject samples to different acceleration forces.

In circular motion, acceleration is the product of radial distance, the square of angular velocity and the acceleration relative to "g." This is traditionally referred to as "relative centrifugal force" (RCF). The acceleration is measured in multiples of "g" the standard acceleration due to gravity at the Earth's surface which is a dimensionless quantity given by the radius times the angular velocity squared and divided by "g."

BRIEF DESCRIPTION OF THE DRAWINGS

Embodiments of the described apparatus are illustrated only as examples in the figures of the accompanying drawing sheets wherein the same element appearing in various figures is referenced by a common reference mark.

DETAILED DESCRIPTION

Figure 1:
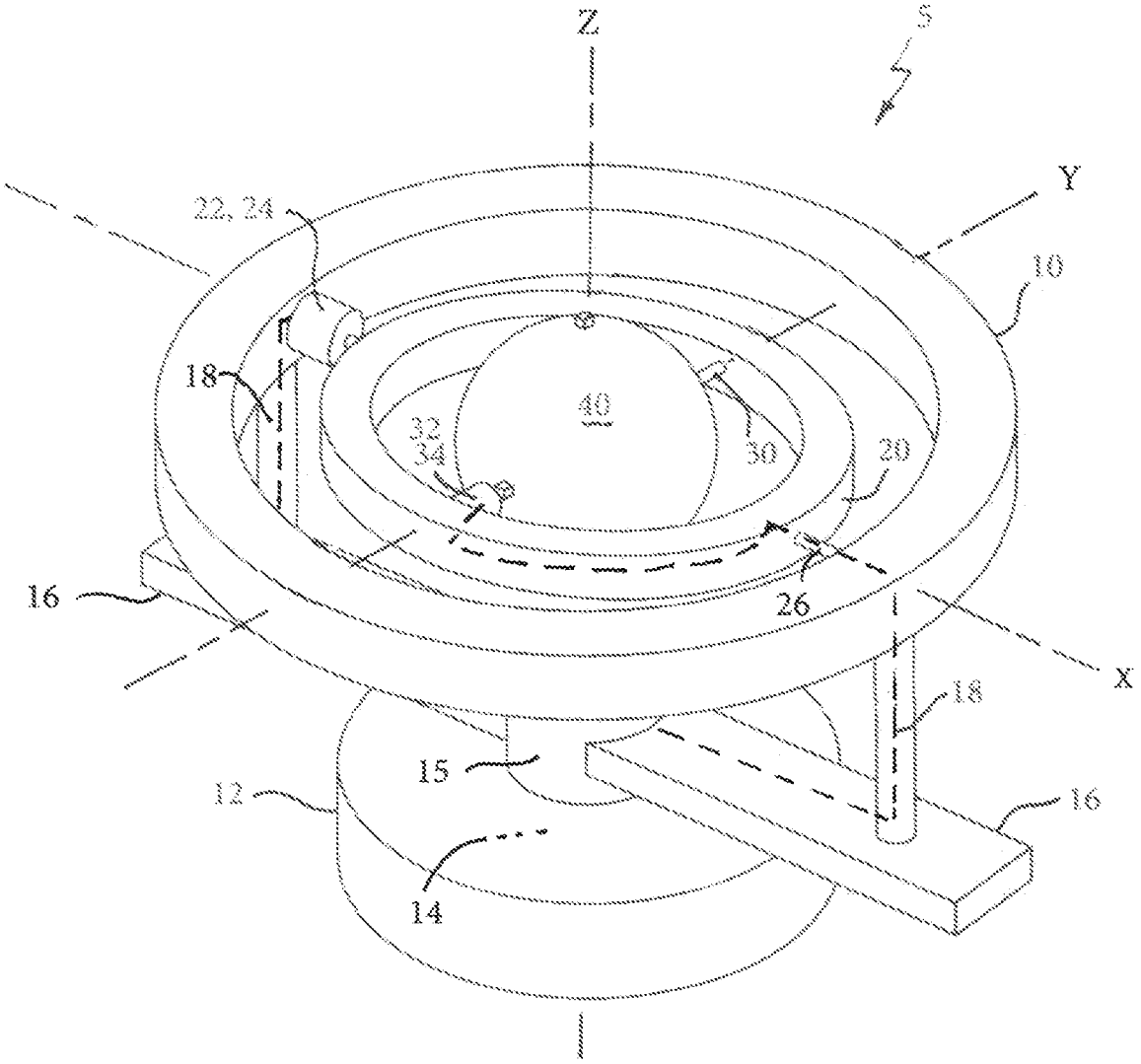
FIG. 1 is a perspective view of the invention shown with an inner ring aligned with an outer ring in an X-Y plane.
Figure 2:
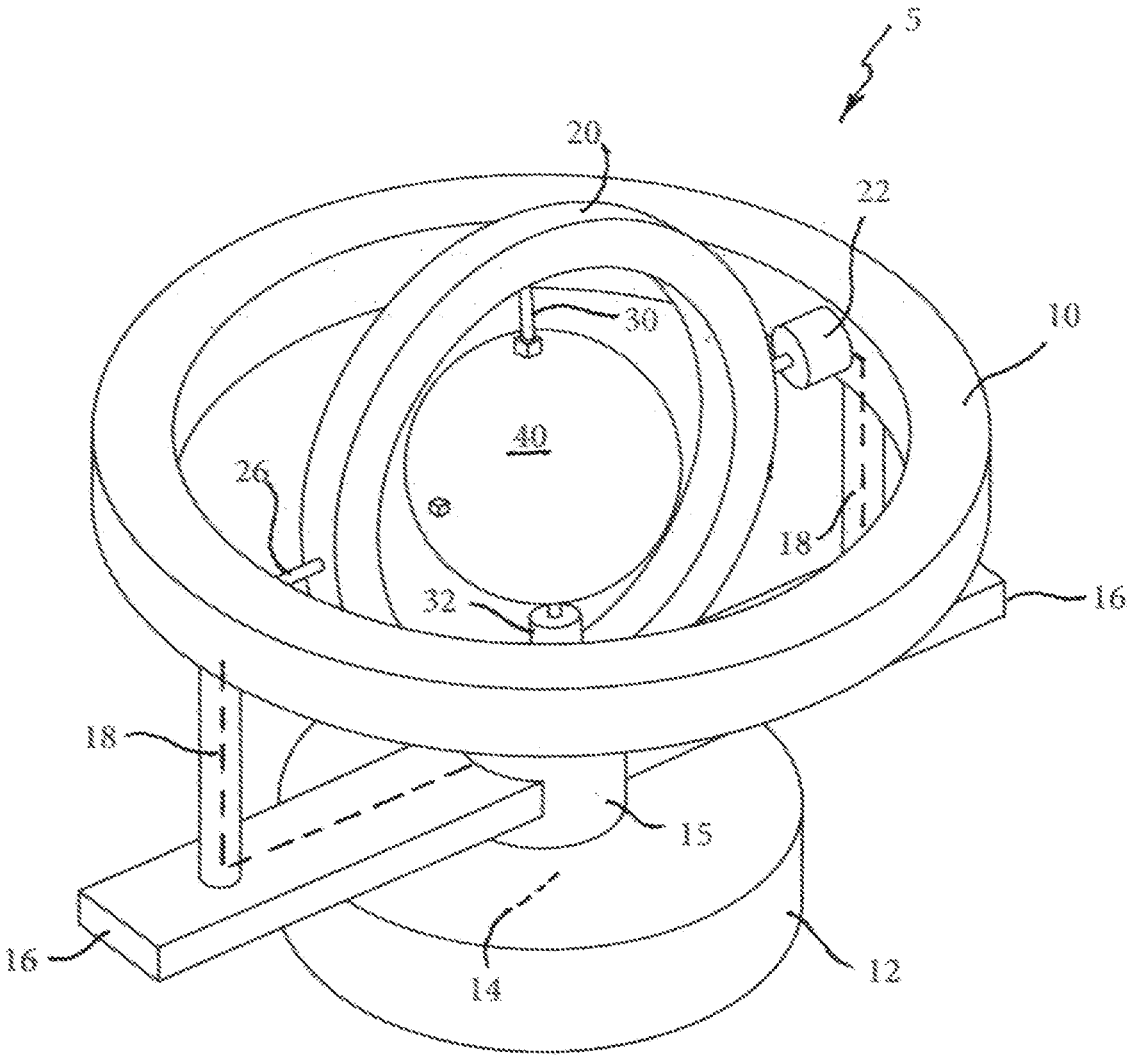
FIG. 2 is perspective view thereof shown with the outer ring rotated by 90° in the clockwise sense about a Z axis, and the inner ring is shown rotated by 90° in a counter-clockwise sense about an X axis.

The invention is a multi-axis centrifuge 5 as shown in FIGS. 1 and 2, and this description will refer to X, Y, and Z axes, as shown, as well as the planes that these axes define, i.e., the X-Y plane, the X-Z plane and the Y-Z plane. Centrifuge 5 may be made of structural materials of any type such as metal or engineering polymers and may be operated by a mechanical drive using electrical motors 14, 22, and 32 of any type as shown and described. Alternately, centrifuge 5 may be operated by fluidic drives, magnetic drives or other well-known drive types. Motor 14 may be enclosed within a stationary base 12 may be joined to operate a centrally located hub 15 in rotation about the Z axis as shown in FIG. 1. A pair of colinear arms 16 may be joined to, and rotate with, hub 15 in parallel with the X-Y plane as also shown in FIG. 1. A pair of rods or struts 18 may extend from arms 16 in support of an outer ring 10 which may lie in the X-Y plane as shown. An inner ring 20 may be positioned concentric with outer ring 10 as shown and further may be joined by motor 22 having a bearing set 24 and axle 26 to outer ring 10.

It should be clear to those of skill in the art that outer ring 10 may be eliminated, and instead, in a further embodiment, simply arranged to have inner ring 20, motor 22 with its bearing set 24, and axle 26 supported directly by struts 18.

It should be understood that as hub 15 and outer ring 10 rotate, motor 22 may simultaneously rotate inner ring 20.

As shown in the figures, a spherical capsule 40 may be positioned centrally and concentrically within both inner ring 20 and outer ring 10. Capsule 40 may be hollow so that it may have an interior surface which may be spherical or may have any other shape whatsoever. Capsule 40 may be engaged with inner ring 20 by axle 30, and motor 32 with its bearing set 34. Motor 32 may be able to drive axle 30 and capsule 40 in rotation about the Y axis.

Motors 14, 22, and 32 may be operated independently with any one of said motors rotating or not and each motor may be operated in either rotational sense. Indeed, each motor may be adjusted to a selected rotational velocity and, additionally, each may be operated in any sequence of back and forth rotation according to a present or adjustable program.

The primary objective of centrifuge 5 is the separation of fluid, semi-solid, or solid species as described in the preceding Background. Such species shall be referred to herein as comprised of "particles" which may be small pieces of solid materials, molecules, gaseous or liquid elements, or atomic particles. A further objective may be achieved by applying back and forth agitation programs which can result in the beneficial mixing of species having similar masses while those of differing masses are separated. With effective separation by high speed spinning of capsule 40, interposed with rotational agitation for mixing, both may be accomplished simultaneously.

It should be recognized that the spinning of capsule 40 about only the Y axis using motor 32 will result in separating a material with a gradation of particle masses with heavier masses moving toward the interior surface of capsule 40 forming a torus shape or a flat band, i.e., a ring, of heavy mass particles and such a ring will be circumscribed about the Y axis and lie in the X-Z plane. The ring will have a cross-sectional shape associated with a gaussian profile, that is; the probability density function of a normally distributed random variable. The center will be aligned with the X-Z plane. With higher rotational speeds, the center magnitude will increase and the value of sigma, a measure of the spread, will diminish, i.e., the width of the ring will decrease.

Alternately, if in addition to the rotation of motor 32, motor 22 were to also be operated causing rotation of inner ring 20, heavier mass particles will tend to migrate not only to a ring lying in the X-Z plane, but also to form a ring lying in the Y-Z plane. Assuming the velocities of motors 32 and 22 were equal the heavier mass particles will spread out in association with both the X-Z and the Y-Z planes while lighter mass particles will be displaced toward the X-Y plane. At relatively low rotational velocities, heavier particles will migrate radially and appear to be smoothly spread-out between the X-Z and Y-Z planes. However, as rotational velocities increase two distinct rings will start to form, one associated with each of the X-Z and Y-Z planes. These two rings will achieve total masses in proportion to their respective rotational velocities.

In the same manner as described above, when motors 14, 22, and 32 are operated simultaneously, at slow rotational speeds heavy particles will tend to be uniformly distributed in contact around the entire interior surface of capsule 40. However, as motor rotation increases, separate rings will tend to grow in alignment with the three respective planes X-Y, X-Z, and Y-Z, and at significant rotational velocities, three distinct rings of heavier mass particles will form against the interior surface of capsule 40 while lighter mas particles will tend to align within the interior of each of the three rings with the lightest mass particles positioned at the center.

It is well known in the art to disassemble a centrifuge container such as capsule 40 to retrieve separated materials. This could be accomplished by removing capsule 40 from axle 30 and then separate the two hemispheres to acquire the materials within.

The dashed lines in FIGS. 1 and 2 represent electrical conductors. Electrical power may be fed into base 12 by a power line (not shown) or base 12 may contain an electrical energy storage battery (not shown). Electrical power may be fed to motors 14, 22, and 32 separately as is well known in the art through sliding electrical contractors. A controller (not shown), such as a common industrial motor controller may be used to operate motors 14, 22, and 32 as to their speed and operating program, as is also well known in the art.

In the foregoing description, embodiments are described as a plurality of individual parts, and methods as a plurality of individual steps and this is solely for the sake of illustration. Accordingly, it is contemplated that some additional parts or steps may be added, some parts or steps may be changed or omitted, and the order of the parts or steps may be re-arranged, while maintaining the sense and understanding of the apparatus and methods as claimed.

What is claimed is:

1. A centrifuge positioned in a three-axis coordinate system, said centrifuge comprising:

a mechanical drive;

a capsule engaged with said mechanical drive wherein said capsule is engaged with said mechanical drive to rotate about mutually orthogonal X, Y, and Z axes of said coordinate system;

a stationary base having a first motor of the mechanical drive, wherein said first motor operates a centrally located hub in rotation about said Z axis and the hub has a pair of colinear arms oriented in parallel with an X-Y plane of the coordinate system; and a pair of struts extending from the colinear arms, the struts supporting a second motor of the mechanical drive, wherein the second motor is engaged with an inner ring and enabled for rotating said inner ring relative to said struts about said X axis.

2. The centrifuge of claim 1 wherein the pair of struts extending from said collinear arms, said struts supporting an outer ring.

3. The centrifuge of claim 2 wherein the inner ring is positionally concentric with said outer ring.

4. The centrifuge of claim 3, wherein said second motor is engaged with both said outer ring and said inner ring and enabled for rotating said inner ring relative to said outer ring about said X axis.

5. The centrifuge of claim 4 further comprising a third motor of said mechanical drive, wherein said third motor is engaged with both said inner ring and said capsule wherein said third motor is enabled for rotating said capsule relative to said inner ring about said Y axis.

6. The centrifuge of claim 1 further comprising a third motor of said mechanical drive, wherein said third motor is engaged with both said inner ring and said capsule wherein said third motor is enabled for rotating said capsule relative to said inner ring about said Y axis.

7. The centrifuge of claim 6 wherein said first, second, and third motors are operable independently and simultaneously.

* * * * *